US005815962A

United States Patent [19]

Emberson-Nash et al.

[11] Patent Number: 5,815,962

[45] Date of Patent: Oct. 6, 1998

[54] ATTACHABLE HEAT SHIELD FOR HAND IRON SOLEPLATES

[76] Inventors: Walter Emberson-Nash; Michael Walshe, both of 634 S. Millitary Trail, Deerfield Beach, Fla. 33442

[21] Appl. No.: 939,579

[22] Filed: Sep. 29, 1997

[51] Int. Cl.[6] ..... D06F 75/38

[52] U.S. Cl. ..... 38/97

[58] Field of Search ..... 38/74, 81, 94, 38/97, 75, 80, 93; 219/245, 254

[56] References Cited

U.S. PATENT DOCUMENTS

| | | | |
|---|---|---|---|
| 2,458,530 | 1/1949 | Resnick | 38/94 |
| 2,659,167 | 11/1953 | Weldon | 38/97 |
| 2,990,635 | 7/1961 | Rogers | 38/97 |
| 3,905,138 | 9/1975 | Abolafia | 38/97 |
| 4,209,921 | 7/1980 | Kochauf | 38/97 |
| 5,664,349 | 9/1997 | White et al. | 38/97 |

*Primary Examiner*—Ismael Izaguirre
*Attorney, Agent, or Firm*—Malin, Haley, DiMaggio & Crosby, P.A.

[57] ABSTRACT

An improved cover for the soleplate of a hand iron that is quickly and easily attached to the iron's soleplate by a pair of tension members. The cover is fabricated from a single, relatively thin sheet of friction reducing PTFE material and functions to reduce frictional forces while ironing. The cover includes a plurality of steam vent holes, distributed in two separate patterns, allowing steam to flow through the cover from the steam holes conventionally provided in the iron's soleplate. Water leakage is prevented around the periphery of the iron by the formation of an upwardly turned lip around the periphery of the iron soleplate. Water leakage from the rear edge is prevented by a flap formed along the rear edge of the device. The rear flap and rear portion of the PTFE cover define a volume which retains water draining thereto when the iron is placed in its standing position. The invention provides an effective, low friction, heat shield for a hand pressing iron which provides improved steam distribution.

9 Claims, 4 Drawing Sheets

ATTACHABLE HEAT SHIELD FOR HAND IRON SOLEPLATES

BACKGROUND OF THE INVENTION

1. Field of the Invention

The present invention generally relates to the pressing and smoothing of fabrics using a hand iron, and more particularly to an attachable soleplate cover for hand irons for preventing the scorching burning or polishing of fabrics and the like during the ironing process.

2. Description of the Background Art

The task of ironing involves the elimination of wrinkles in fabrics and clothing, and is well-known throughout the world. While the introduction of improved natural and synthetic fabrics has made the elimination of wrinkles and the pressing of fabrics easier, it remains, common practice to press fabrics using a heated hand iron.

The pressing of fabrics using a hand iron can be a burdensome chore since common hand irons can be quite heavy, thereby making ironing a tiresome chore. Furthermore, the act of ironing, namely, the manual manipulation of a hand iron across an article's surface, generate frictional forces making the ironing task even more difficult.

Accordingly, the background art reveals improvements in hand irons directed to reducing frictional forces, between the soleplate of the iron and the underlying article, encountered by a user. The background art reveals attempts to reduce the frictional forces experienced while ironing by use of polished soleplates and/or the application of coatings comprising low-friction materials such as polytetrafluroethylene (hereinafter "PTFE") a compound which is available under the trademark Teflon™ by E. duPont De Nemours Corp. While the use of PTFE in reducing frictional forces in hand irons shows some promise, the devices and methods disclosed in the background art have failed to adequately solve the problem.

One known use of PTFE involves the application of a PTFE coating directly to the iron sole plate during the manufacturing process. PTFE coating's, however, are generally a feature only on select, usually higher priced, irons sold at the retail level. One disadvantage with the use of PTFE materials is that PTFE is not durable, and, over time, PTFE coatings will wear from iron soleplates thereby exposing underlying articles to bare metal. Since exposure of the metal forming an iron's soleplate results in increased frictional forces while ironing, the background art reveals attempts at improving iron soleplates by attachment of PTFE coatings and the like to the soleplate. In addition, many models of irons do not include a PTFE coating on the soleplate.

As a result of the reasons set forth hereinabove, the background art reveals a number of devices for use with a hand iron for removably attaching a friction reducing cover to the soleplate of fabric pressing hand irons. The background art reveals a cover formed of a thin sheet of PTFE material that is removably attachable to an iron. Such devices include a plurality of steam vent holes such that when installed, steam is allowed to flow from the steam holes conventionally provided in the soleplate steam irons through the holes defined by the cover.

U.S. Pat. No. 2,458,530, issued to Resnick, discloses a combing and brushing attachment for irons. U.S. Pat. No. 3,142,916, issued to Jacobson, discloses an accessory for garment steaming devices, comprising a perforated metal plate coated with PTFE plastic. U.S. Pat. No. 3,905,138, issued to Abolafia, discloses a steam iron shoe comprising a metal plate and a PTFE coating disposed about a fabric layer. U.S. Pat. No. 3,930,325, issued to Schaefferal, discloses a steam iron soleplate construction having a soleplate formed from a relatively thin sheet of material. U.S. Pat. No. 4,209,921, issued to Kochauf, discloses a flat iron foil formed of a relatively thick sheet of PTFE material. The Kochauf device includes a plurality of ridges along an upper surface to space the steam vent holes from the iron soleplate. U.S. Pat. No. 4,665,637, issued to Kramer, discloses a soleplate coating for a fabric pressing device comprising a ceramic layer bonded to the metal soleplate of an iron. U.S. Pat. No. 4,800,661, issued to Yamamoto et al., discloses an electric iron having a PTFE coating on the soleplate thereof. U.S. Pat. No. 4,856,212, issued to Dikoff, discloses a cordless iron with a high temperature non-scorching soleplate surface. Dikoff discloses a coating comprising a thin film which is permanently bonded to the soleplate of the iron. U.S. Pat. No. 5,165,184, issued to Gardaz, et al., discloses an ironing device soleplate coated ribs, including a PTFE or enamel coating bonded to the soleplate. U.S. Pat. No. 5,165,185, issued to Gardaz et al., describes an iron device soleplate with resin projections which comprises a series of spaced-apart ribs extending from a PTFE coating bonded to the iron soleplate.

Finally, U.S. Pat. No. 5,664,349 issued to White, et al. discloses a removable soleplate cover for fabric pressing irons formed of a thin, flat planar sheet of PTFE material which is removably securable to the soleplate of a hand operated iron for protecting fabrics being pressed from burning, scorching and polishing by reducing friction between the iron and the fabric, while also providing for a more even distribution of heat from the soleplate. The device defines a plurality of small steam vent holes in a V-shaped pattern for allowing the passage of steam therethrough. FIGS. 1 and 2 represent a prior art removable soleplate cover for an iron as disclosed by White, et al. The White device, however, includes a number of inherent disadvantages and therefore has not gained wide commercial acceptance. Specifically, the device is burdened with an inefficient design resulting in a soleplate cover that is difficult to attach to an iron, and lacks support in critical peripheral regions. The device disclosed by White is removably secured to the soleplate of an iron by complex and inefficient forward and rearward lateral flaps, and a pair of springs attached to the rearward flaps. The rearward flaps include eyelets to which tensile springs must be connected. It has been found that the spring attachment and flap arrangement disclosed by White fails to provide adequate support to the upwardly turned sides, thereby allowing the sides to flatten outwardly from the iron thus allowing water to flow cut the sides of the device. In addition, as seen in FIG. 2, the rearward edge of the White device does not include an upwardly turned edge lip, and thus allows water to freely flow from the rear edge, particularly when the iron is stood vertically on its back end (hereinafter "standing position"). Furthermore, the White device suffers from a pattern of steam holes that provides inefficient steam distribution, particularly when one considers the differences and diversity of steam hole patterns found in various makes and models of irons.

Accordingly, there exists a need for an improved attachable PTFE cover for the soleplate of a hand pressing iron that is easily and securely attachable to the sole plate of an iron and which provides an upwardly turned lip substantially around the periphery thereof, while incorporating an improved network of steam holes therein, for improving the pressing of articles during the ironing process.

SUMMARY OF THE INVENTION

An improved cover for the soleplate of a hand iron that is quickly and easily attached to the iron's soleplate by a pair of tension members. The cover is fabricated from a single, relatively thin sheet of friction reducing PTFE material, or an equivalent thereof, for reducing frictional forces, between the soleplate of the iron and the underlying article, and includes a plurality of steam vent holes so that steam is allowed to flow through the cover from the steam holes conventionally provided in the iron's soleplate. The cover of the present invention prevents the leakage of water from the periphery of the iron by defining an upwardly turned lip around the iron's periphery. The peripheral lip is maintained by forward and rearward tension members that are specifically positioned to provide improved support to the upwardly turned edges of the device. Water is prevented from leaking from the rear edge of the device by a flap formed along the rear edge of the device. The rear flap and rear portion of the PTFE cover define a volume which retains water draining thereto when the iron is placed in its standing position. The invention provides an effective, low friction, heat shield for a hand pressing iron which provides improved steam distribution.

Accordingly, it is an object of the present invention to provide an improved attachable PTFE cover for the soleplate of a hand iron.

It is also an object of the present invention to provide an improved cover for the soleplate of an iron that prevents water leakage from the periphery of the iron's soleplate.

Yet another object of the present invention is to provide an improved cover for the soleplate of an iron that prevents water leakage rearwardly of the iron when in use, and when the iron is placed in a standing position.

Still another object of the present invention is to provide an improved cover for the soleplate of an iron having an improved pattern of steam vent holes therein.

In accordance with these and other objects which will become apparent hereinafter, the instant invention will now be described with particular reference to the accompanying drawings.

DESCRIPTION OF THE PREFERRED EMBODIMENTS

With reference now to FIGS. 3–6, there is depicted the improved soleplate cover, generally referenced as 10, for a hand iron "I". Cover 10 is preferably fabricated from polytetrafluroethylene (PTFE) material, as that material available from E. DuPont de Nemours Corporation under the trademark Teflon. PTFE is recognized as having a relatively low coefficient of friction, and has been found to have suitable heat resistant characteristics for use with the heated surface of a pressing iron without melting. PTFE has a melting point of approximately 500 degrees Fahrenheit (260° C.), while the soleplate of a typical household iron reaches temperatures of approximately 350 degrees Fahrenheit (177° C.). Thus, while the invention contemplates the use of PTFE material, it should be apparent that any suitable material having a low coefficient of friction and appropriate thermal characteristics is considered within the scope of the present invention.

Figure 1:
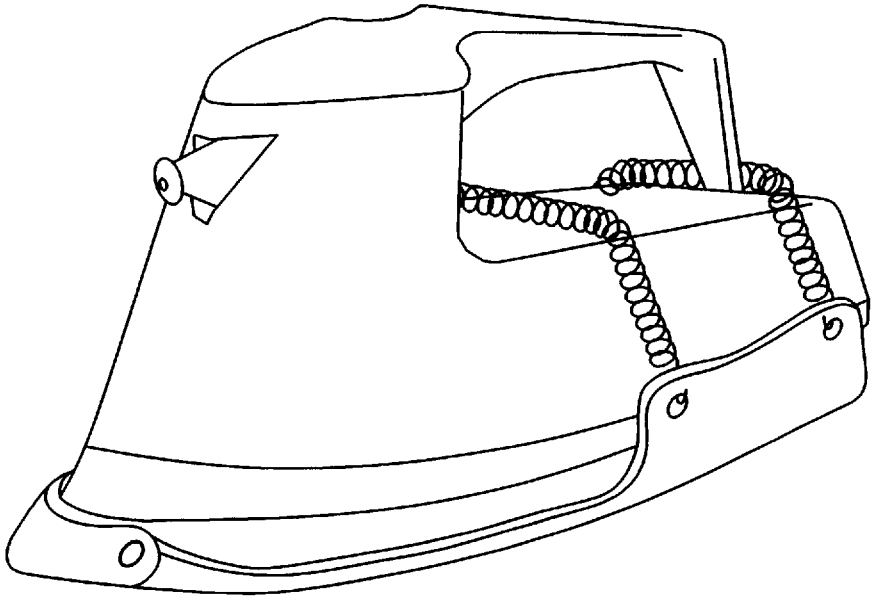
Fig. 1 (Prior Art)
FIG. 1 is a perspective view of an iron soleplate cover found in the background art installed on a hand iron.
Figure 2:
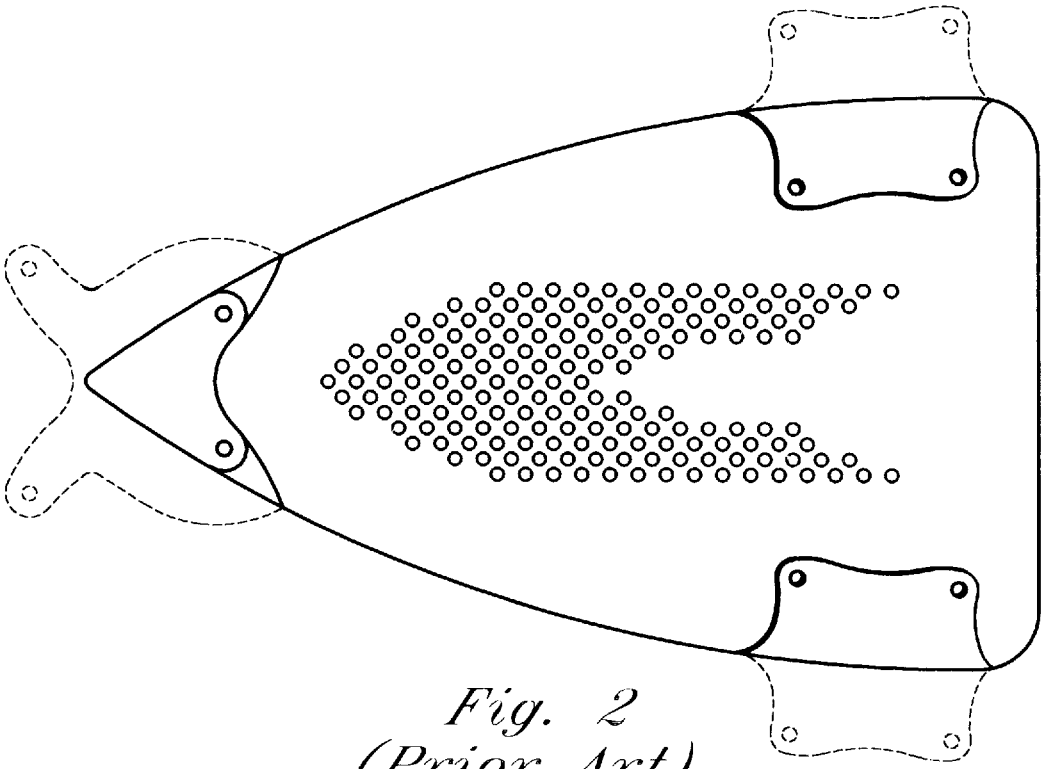
Fig. 2 (Prior Art)
FIG. 2 is a top plan view of the iron soleplate cover of the background art depicted in FIG. 1.
Figure 3:
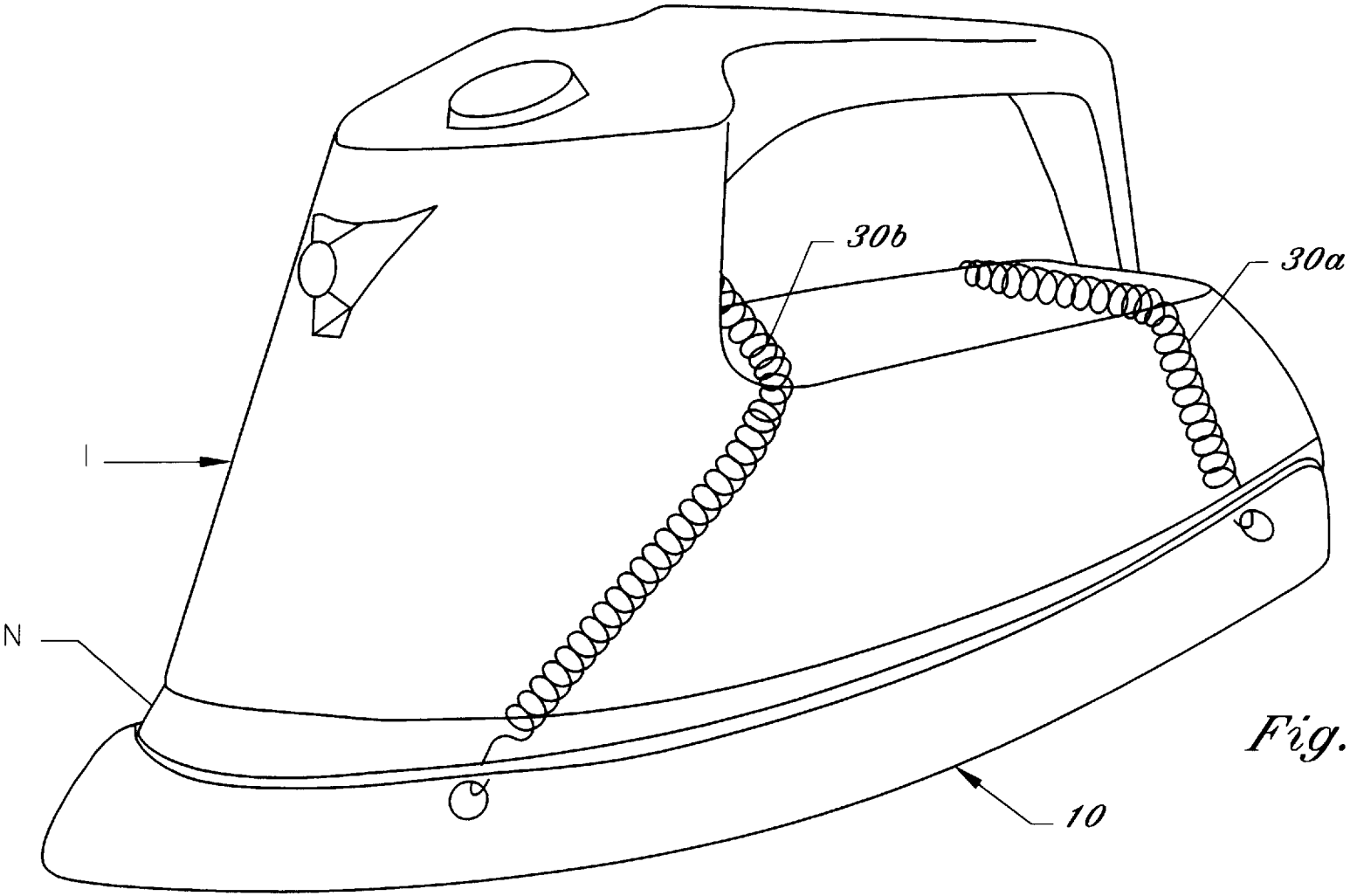
FIG. 3 is a perspective view of the iron soleplate cover of the present invention installed on a hand iron.

FIG. 3 depicts the cover device according to the present invention installed on a fabric pressing hand iron "I". Cover 10 is preferably formed of a thin, flat, planar sheet of PTFE material. Cover 10 is relatively thin, but may be thicker depending upon the application, and it should be noted that this thickness has been exaggerated in the drawings for reasons of clarity. As further depicted in FIG. 4, cover 10 is formed in the general shape of the heatable soleplate of a typical fabric pressing hand iron having a generally V-shaped configuration with symmetrically disposed opposing first and second side portions defining convex curvalinear side edges 12 and 14 which converge at a front end, generally referenced as 16, and a substantially straight rear edge 18.

Figure 4:
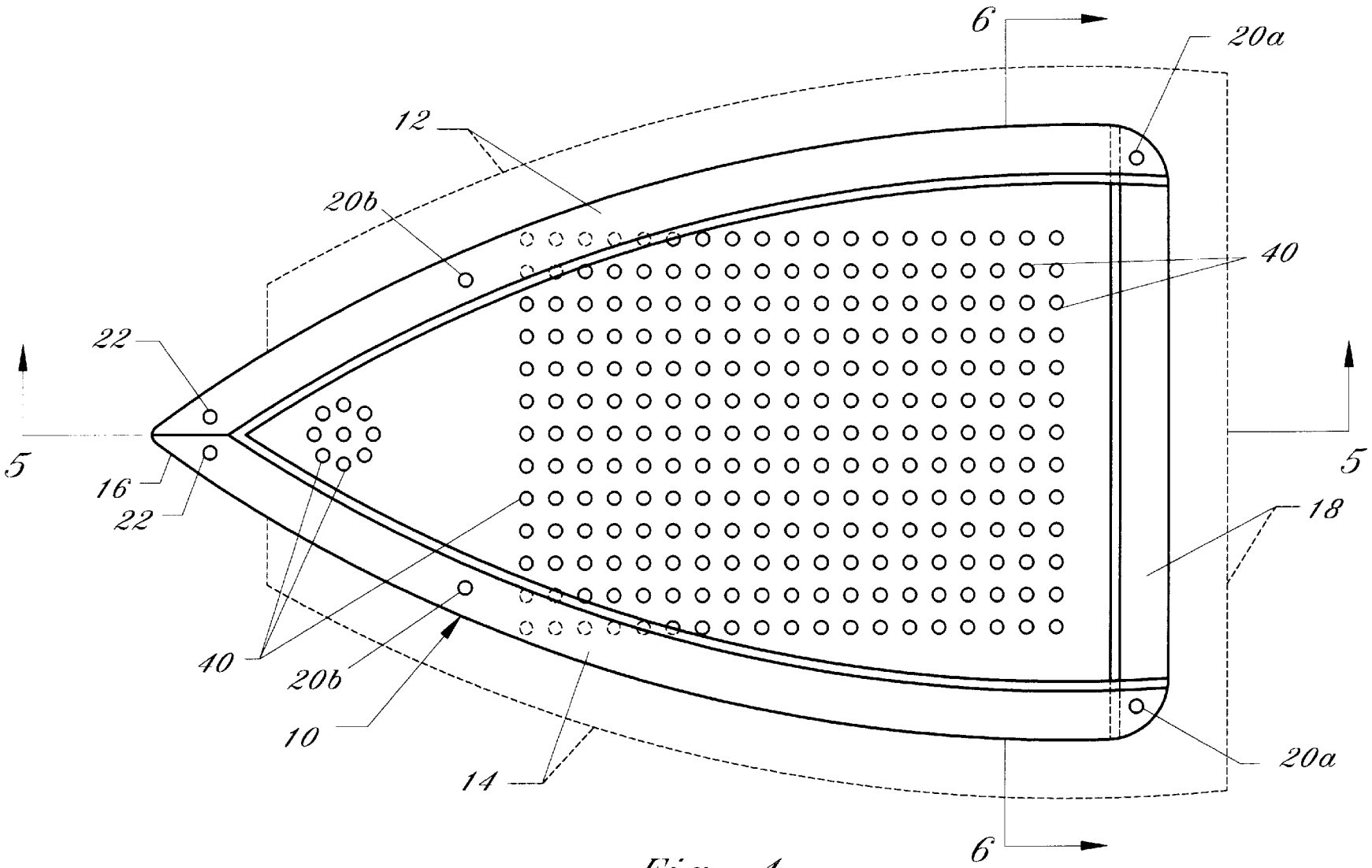
FIG. 4 is a top plan view of the iron soleplate cover of the present invention.
Figure 5:
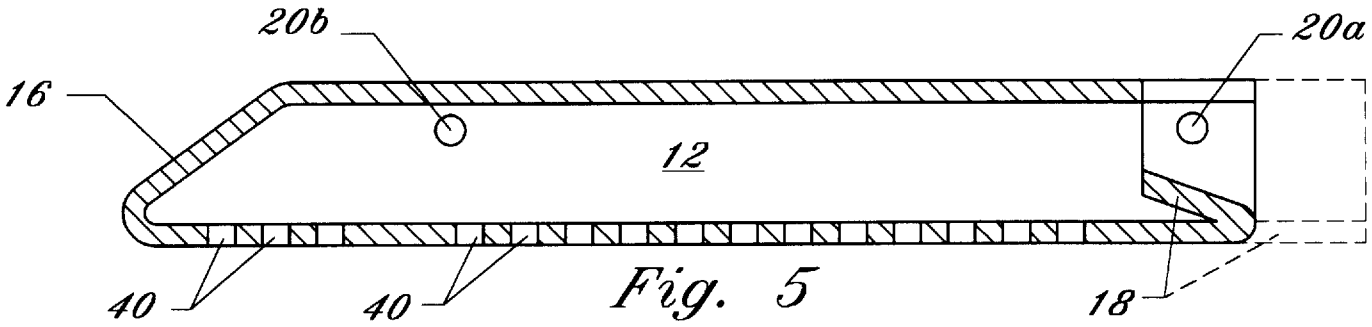
FIG. 5 is a side elevational view in section along line 5—5 of FIG. 4.
Figure 6:
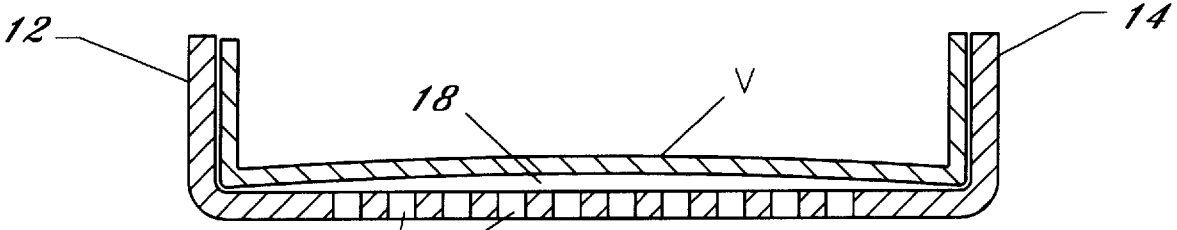
FIG. 6 is a rear end elevational view in section along line 6—6 of FIG. 4.

As seen in FIGS. 4–6, a peripheral lip is formed by folding edges 12 and 14 upwardly such that the side portions of cover 10 prevent water accumulating between the cover and the soleplate of an iron from leaking out the sides. In FIGS. 4 and 5, the peripheral portions of cover 10 are shown in their formed configuration with solid line representation, and in their unformed or unfolded configuration with broken line configuration. Each side of cover 10 includes first and second tensioner connecting sites for connection of a tensioning apparatus as more fully discussed herein below. In the preferred embodiment, the tensioner connecting sites comprise apertures 20*a* and 20*b*. The tensioner connecting sites are strategically positioned along the length of edges 12 and 14 so as to maintain the peripheral lip and prevent the side portions from folding away from the sides of the iron "I", by providing support along the entire length of each edge, while keeping cover 10 securely attached to the iron. In the preferred embodiment, first apertures 20*a* are located substantially toward rear edge 18, while second apertures 20*b* are located sufficiently forward to prevent edges 12 and 14 from folding away from the sides of the iron, and thus preventing water from leaking from between the iron soleplate and cover 10 along the side edges 12 and 14, as well as maintaining the side edges substantially adjacent to the sides of the iron so as to prevent the heated sides of the iron soleplate contacting delicate, heat sensitive material. The positioning of apertures 20*a* and 20*b* provides improved structural support of cover 10, and particularly of the peripheral lip, over devices of the background art. The present invention further improves upon devices of the background art by providing a peripheral lip that extends sufficiently up the sides of the iron so as to completely cover the sides of the soleplate. In an alternate embodiment the tensioner connecting sites may be secured directly to the iron by patches of hook and loop fastening material affixed to the iron and cover respectively.

As should be apparent, the device includes a pre-formed nose pocket. The nose pocket may be formed in any suitable manner, such as a pocket formed by the upward folding of part of side edges 12 and 14 to form a nose pocket proximate cover front end 16 for receiving the nose "N" of hand iron "I", an example of which is illustrated in FIGS. 3 and 4. Accordingly, cover front end 16 may include a cut-out portion or other suitable modification for facilitating the formation of the nose pocket. In addition, the nose pocket may be anchored or otherwise maintained by suitable fasteners 22. It is further contemplated that the nose pocket may be formed by the use of additional structure, such as a prefabricated nose piece.

The rearward portion of cover 10 includes a rear flap formed by folded rear edge 18, best depicted in FIGS. 4–6. Water is prevented from leaking from the rear edge of the iron/cover assembly by the folded flap formed along the rear edge of the device. The rear flap and rear portion of the PTFE (or other suitable material) cover define a volume "V" which retains water draining thereto when the iron is placed in its standing position.

Cover 10 is attached to hand iron I by mating placement of cover 10 relative to the soleplate, a position wherein the noses N of the iron is received within the nose pocket formed at front end 16, and the use of suitable tensioning apparatus 30. In the preferred embodiment tensioning apparatus 30 may comprise helical springs, 30*a* and 30*b*. In an alternate embodiment, tensioning straps, incorporating hook and loop fastening material such as Velcro™ (not shown), are contemplated for providing versatility and ease of adjustment.

Cover 10 further defines a plurality of steam vent holes 40. It has been found that steam flowing from vent holes in the iron soleplate is best dispersed by a uniform distribution of steam vent holes, especially since the size, number, and location of steam vents varies from one model of iron to the next. For example, some irons may have steam vent holes only along the periphery of the soleplate, while other irons may have steam vent holes that are centrally disposed. Accordingly, as best depicted in FIG. 4, the present invention incorporates a plurality of steam vent holes uniformly dispersed in first and second patterns. By uniformly dispersing steam vent holes there is no requirement for any steam hole(s) to be aligned with any corresponding steam vent holes in the soleplate. In the preferred embodiment, the first pattern includes steam vent holes 40 uniformly dispersed in the shape of a quadrilateral, such as a square or rectangle; and the second pattern is disposed between the first pattern and the cover front end 16, and preferably defines a circular pattern. The use of a circular pattern disposed toward front end 16 further functions to concentrate steam in a location suitable for removing wrinkles from portions of an article that are most easily pressed by the heated nose portion of the iron's soleplate. In an alternate embodiment contemplated by the present invention, the second pattern may define an alternate shape, e.g. elliptical, for providing steam distribution holes disposed substantially close to the front end of the cover for receiving steam originating near the nose of the iron soleplate.

Accordingly, the hand iron soleplate cover of the present invention provides a useful accessory for common hand irons, whether or not the hand iron is originally manufactured with a low friction PTFE soleplate coating, including irons having damaged or worn PTFE soleplate coatings. Cover 10 may be economically manufactured as a substantially flat planar sheet and may be substantially formed in a single machine stamping process. In addition, it has been found that forming cover 10 using a stamping process forms protuberances projecting from cover 10 toward the soleplate of the iron, which protuberances function by creating steam channels for facilitating the even distribution of steam. Accordingly, the PTFE iron soleplate cover of the present invention provides very uniform distribution of both steam and heat, thereby helping to prevent scorching or burning of articles being pressed, thereby eliminating the need for an intermediate press cloth or the like. Furthermore, the low frictional characteristics of the cover material prevent the shine or polishing experienced when ironing certain materials by direct application of the iron soleplate.

As is now apparent, cover 10 is easily attached to the soleplate of an iron I, by insertion of the nose N of the iron into the nose pocket formed at the front end 16 of cover 10, and by connection of first and second tensioners 30*a* and 30*b*. Tensioners 30*a* and 30*b* thus form and maintain a peripheral lip along cover edges 12 and 14, regardless of whether the PTFE cover has been heated, and is thus more pliable.

The instant invention has been shown and described herein in what is considered to be the most practical and preferred embodiment. It is recognized, however, that departures may be made therefrom within the scope of the invention and that obvious modifications will occur to a person skilled in the art.

What is claimed is:

1. A soleplate cover for a fabric pressing iron, comprising:

a thin, flexible, substantially planar sheet of material characterized as having a low coefficient of friction;

said cover being formed in the general configuration of the soleplate of a hand operated fabric pressing iron, and including opposing curvalinear edges merging at a front end and a substantially straight rear edge;

said front end including means for receiving the nose of a fabric pressing iron;

each of said side edges including first and second tensioner connecting sites, said first tensioner connecting site disposed proximate said rear edge and said second tensioner connecting site disposed approximately midway between said first site and said front end, said tensioner connecting sites for providing for the removable attachment of said cover to the soleplate of an iron;

said rear edge folded back upon said cover to form a water retaining volume;

said cover defining a plurality of steam vent holes therethrough, said holes being uniformly distributed in first and second patterns, said first pattern having the shape of a quadrilateral and said second pattern having a generally circular shape;

said cover achieving thermal contact with the soleplate of the iron, and said opposing side edges and said rear edge forming a continuous peripheral lip around said cover, whereby said cover provides for uniform heat and steam distribution to articles being ironed.

2. A soleplate cover for a fabric pressing iron according to claim 1, wherein said second pattern is elliptical.

3. A soleplate cover for a fabric pressing iron according to claim 1, including a pair of helical spring tensioners, said tensioners each connected to opposing first and second tensioner connecting sites respectively.

4. A soleplate cover for a fabric pressing iron according to claim 1, including a pair of strap tensioners, said strap tensioners each connected to opposing first and second tensioner connecting sites respectively.

5. A soleplate cover for a fabric pressing iron according to claim 4, wherein said strap tensioners include hook and loop fastening material thereon.

6. A soleplate cover for a fabric pressing iron according to claim 1, wherein the shape of said first pattern is a square.

7. A soleplate cover for a fabric pressing iron according to claim 1, wherein the shape of said first pattern is a rectangle.

8. A soleplate cover for a fabric pressing iron, comprising:

a thin, flexible, substantially planar sheet of material characterized as having a low coefficient of friction;

said cover being formed in the general configuration of the soleplate of a hand operated fabric pressing iron, and including opposing curvalinear edges merging at a front end and, a substantially straight rear edge;

said front end including means for receiving the nose of a fabric pressing iron;

each of said side edges including first and second tensioner connecting sites, said first tensioner connecting site disposed proximate said rear edge and said second tensioner connecting site disposed approximately midway between said first site and said front end, said tensioner connecting sites for providing for the removable attachment of said cover to the soleplate of an iron;

a pair of tension members connected to opposing first and second tensioner connecting sites respectively and around portions of an iron when said cover is attached to the soleplate of the iron;

said rear edge folded back upon said cover to form a water retaining volume;

said cover defining a plurality of steam vent holes therethrough, said holes being uniformly distributed in first and second patterns, said first pattern having the shape of a quadrilateral and said second pattern having a generally circular shape;

said cover achieving thermal contact with the soleplate of the iron, and said opposing side edges and said rear edge forming a continuous peripheral lip around said cover, whereby said cover provides for uniform heat and steam distribution to articles being ironed.

9. A soleplate cover for a fabric pressing iron according to claim 8, wherein said second pattern is elliptical.

* * * * *